US005893305A

United States Patent [19]

Liao

[11] Patent Number: 5,893,305

[45] Date of Patent: Apr. 13, 1999

[54] SEMI-AUTOMATIC PISTOLLED SCREWDRIVER WITH THORNY RINGS

[76] Inventor: Yung-chuan Liao, 2F, No. 3-1, Alley 15, Lane Shui Ching, Peitun District, Taichung, Taiwan

[21] Appl. No.: 08/877,164

[22] Filed: Jun. 17, 1997

[51] Int. Cl.[6] ..... B25B 13/00

[52] U.S. Cl. ..... 81/58; 74/144; 81/58.4; 81/490

[58] Field of Search ..... 81/58, 52, 490, 81/58.4, 63.1, DIG. 2; 74/144

[56] References Cited

U.S. PATENT DOCUMENTS 5,174,178 12/1992 Disston, Jr. ..... 81/490

*Primary Examiner*—David A. Scherbel
*Assistant Examiner*—Benjamin M. Halpern
*Attorney, Agent, or Firm*—Bacon & Thomas

[57] ABSTRACT

An improved pistol gripped semi-automatic manually operated screwdriver is provided which provides advantages over conventional semi-automatic pistol gripped screwdrivers. The prior art screwdrivers are generally in the form of a pistol having a handle and a trigger. The trigger is squeezed to activate a sliding rotation actuator mounted on a helically grooved shaft. Pulling the trigger causes the actuator to move along the shaft thereby creating rotation of the shaft as well as a collet or chuck which holds the screwdriver bit. Such prior art devices also include a coiled spring which is adapted to provide a recoil mechanism for the actuator. In the improved device of this invention the screwdriver further includes a ball bearing located in a cup attached to the top of the actuator and a slide slot located within the housing for rolling engagement with a portion of the ball bearing which protrudes into the slot. This arrangement provides improved positioning of the sliding rotation actuator and additionally improves the slidability and stability of the actuator. In addition the improvement of this invention provides a torsion spring attached to the trigger and the handle for recoiling the trigger after the trigger has been pulled. The housing also includes at least one inwardly projecting receptacle for holding screwdriver bits on the outside of the housing so that a selection of screwdriver bits having different types of heads can be easily accessed.

1 Claim, 7 Drawing Sheets

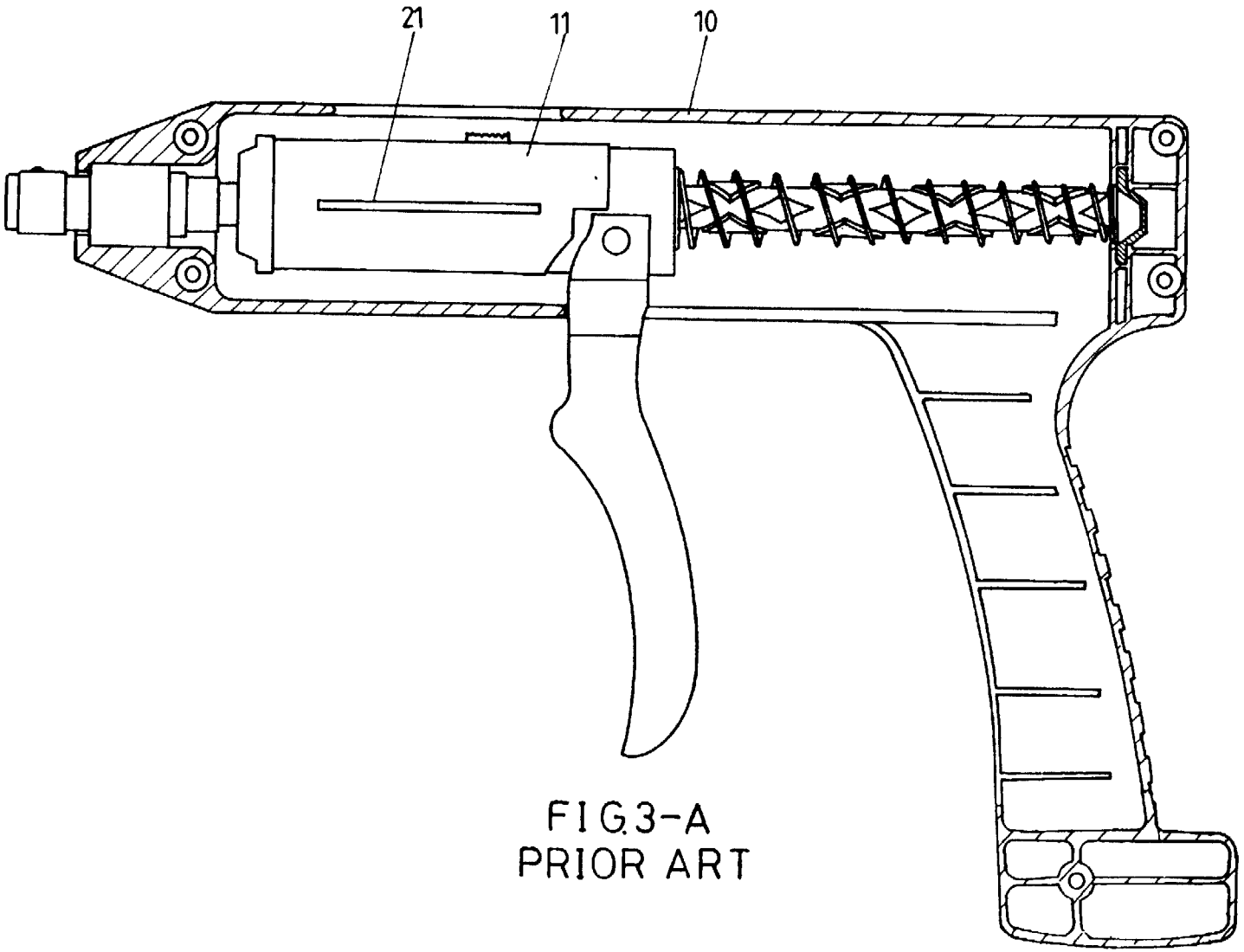
FIG.3-A
PRIOR ART

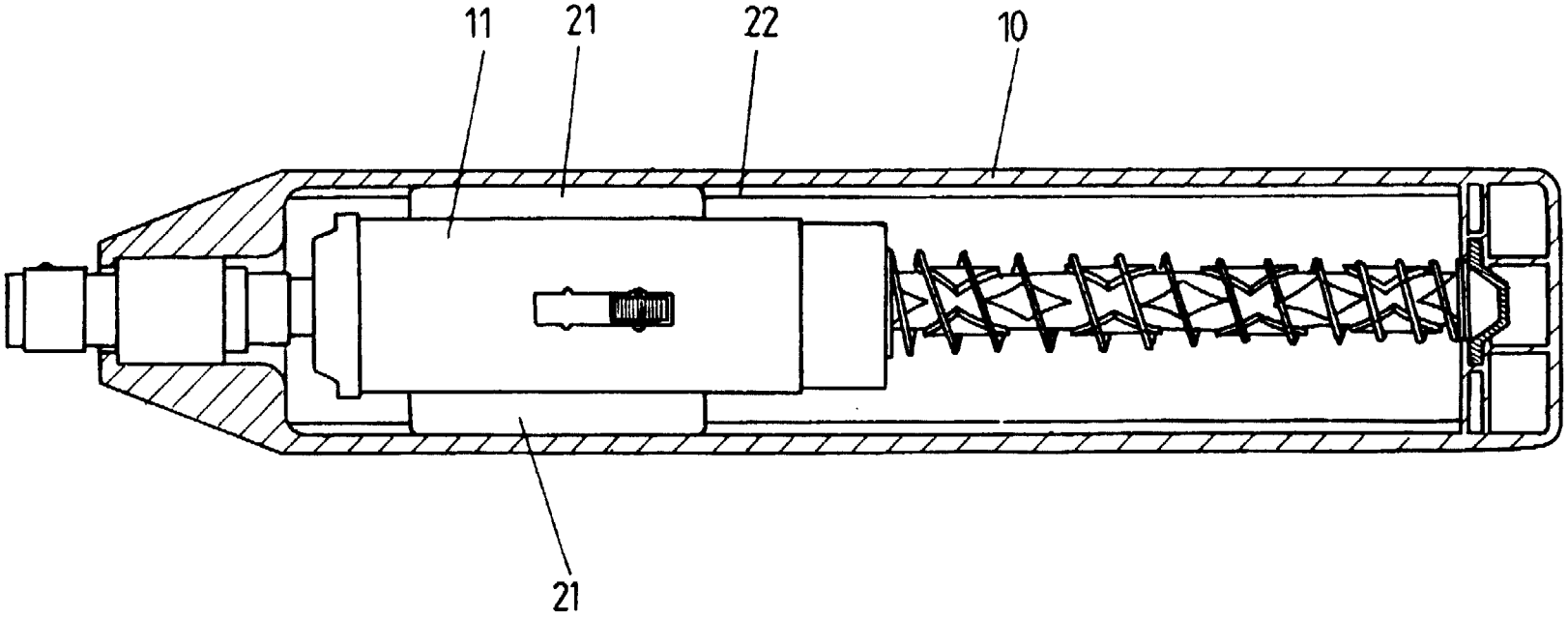
FIG.3-B
PRIOR ART

SEMI-AUTOMATIC PISTOLLED SCREWDRIVER WITH THORNY RINGS

BACKGROUND OF THE INVENTION

1. Field of the Invention

This invention relates to manually operated semi-automatic pistol gripped screwdrivers which have a spring-loaded trigger for actuating rotation of a screwdriver head.

2. Background Information

Semi-automatic pistol gripped screwdrivers generally fall into three different categories. The first category is illustrated in FIG. 1. The first category as shown in FIG. 1 consists of a pistol body (10), one handle or grip 18, one sliding rotation actuator 11, a helically grooved operating rod or shaft 12, a chuck or collet 13 for holding a screwdriver bit, one trigger 14, one spring loaded pulling member 15 and a torsion spring 16. In operation the trigger 14 is pulled rearwardly thereby pushing the spring loaded pulling member 15 in a rearward direction. The spring loaded pulling member 15 is attached to the sliding rotation actuator 11 so that the rearward movement of the pulling member 15 pulls the actuator backwards along the helically grooved operating rod 12, thus actuating rotation of the collet or chuck 13. The motion of the sliding rotation activator 11 along the helically grooved operating rod causes rotation of the chuck or collet 13. A switcher 17 is provided to assure that the helically grooved operating rod and hence the head of the screwdriver rotate in the desired direction.

Screwdrivers of the first category are efficient tools but they have shortcoming due to the complexity of the components and high manufacturing costs. In particular, although the torsion spring and trigger mechanism work well together to return the trigger to its original position, the torsion spring is not sufficient because it becomes weakened through use which results in a loss of function and convenience.

A second category of semi-automatic pistol gripped screwdrivers was developed as an improvement over the first category. The improved screwdriver of the second category, shown in FIG. 2, includes a spring 19 located around the helically grooved operating rod 12 behind the sliding rotation actuator 11. Moving the trigger 20 rearwardly also moves the sliding rotation actuator backwards and compresses spring 19 whereby the compressed spring exerts a force against the sliding rotation actuator in a forward direction so that the actuator can return to the forward position; thus accomplishing the same result achieved in the screwdrivers of the first category.

The second category of screwdrivers does not have the complex structure and higher cost associated with the first category of screwdrivers. However, due to the sliding design of the trigger 20, the sliding rotation actuator 11, trigger 20 and pistol 10 cannot be assembled together tightly. Consequently the sliding rotation actuator 11 and the trigger 20 cannot be pulled at the proper position. This results in undesirable shaking, swinging and undesirable bias of the sliding rotation actuator which reduces the convenience of the whole operation.

The above-noted deficiencies prompted the development of a third category of improved practical screwdrivers as shown in FIGS. 3*a* and 3*b*. The screwdrivers of this third category differ from those of the second category because the screwdrivers of the third category further include a wing piece 21 located on both sides of the sliding rotation actuator 11. Each wing piece 22 fits into a conduction slot 22 located inside the pistol body 10 to assure that the sliding rotation actuator is maintained in the proper position during use. However this improvement only overcomes some of the deficiencies of the second category of screwdrivers.

SUMMARY OF THE INVENTION

It is an objective of the present invention to improve the above-noted deficiencies of the prior art pistol-gripped semi-automatic screwdrivers. This objective as well as others are provided by an improved spring loaded trigger and sliding rotation actuator as well as the further inclusion of a receptacle for holding screwdriver bits on the outside of the tool. The improved sliding rotation actuator includes a ball bearing located in a bearing cup or holder located on the top of the actuator and a sliding slot located inside the top of the pistol body so that the bearing rolls in the slot when the sliding rotation actuator moves forward or backward. This arrangement provides perfect positioning of the sliding rotation actuator and additionally improves the slide and stability of the actuator. In addition two springs are provided which cooperate with each other to improve the recoil action of the trigger and sliding rotation actuator and to improve the life of the mechanism.

BRIEF DESCRIPTION OF THE DRAWINGS

FIG. 3*a* is an assembled sectional view of the third category of prior art screwdrivers.

FIG. 3*b* is a top sectional view of the third category of prior art screwdrivers.

DETAILED DESCRIPTION OF THE INVENTION AND PREFERRED EMBODIMENT

Figure 1:
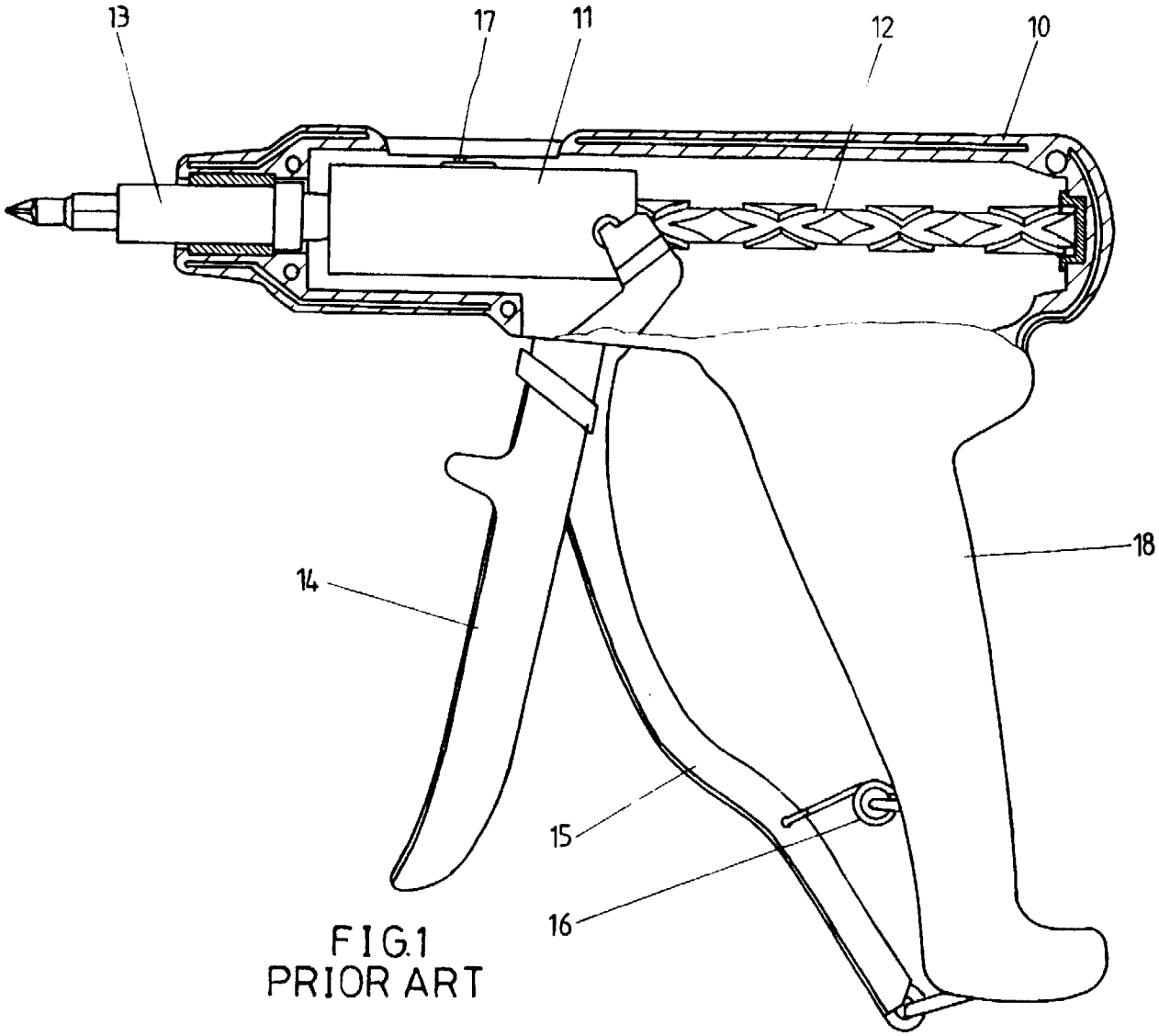
FIG.1 PRIOR ART
FIG. 1 is an assembled sectional view of the first category of prior art screwdrivers.
Figure 2:
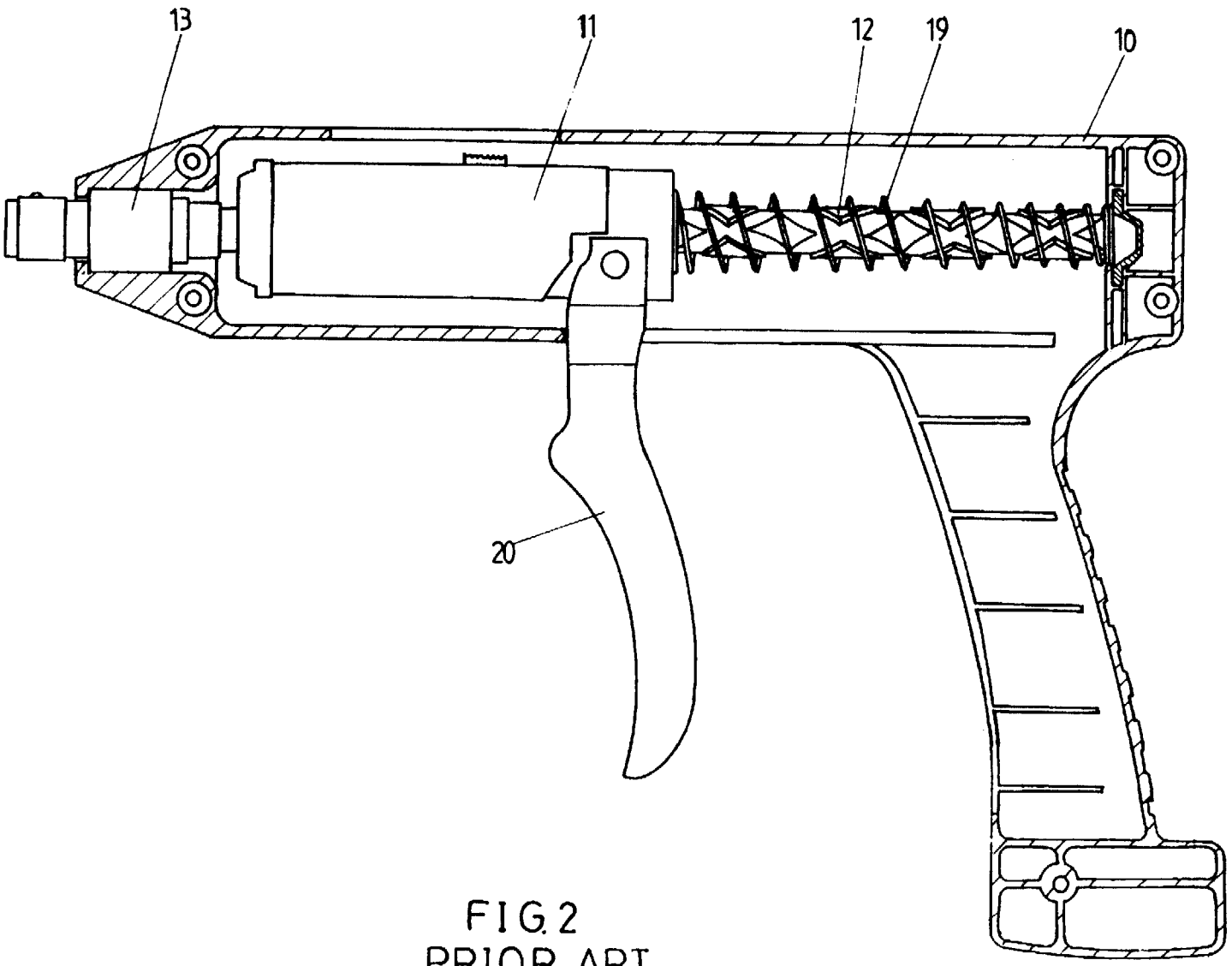
FIG. 2 PRIOR ART
FIG. 2 is an assembled sectional view of the second category of prior art screwdrivers.
Figure 4:
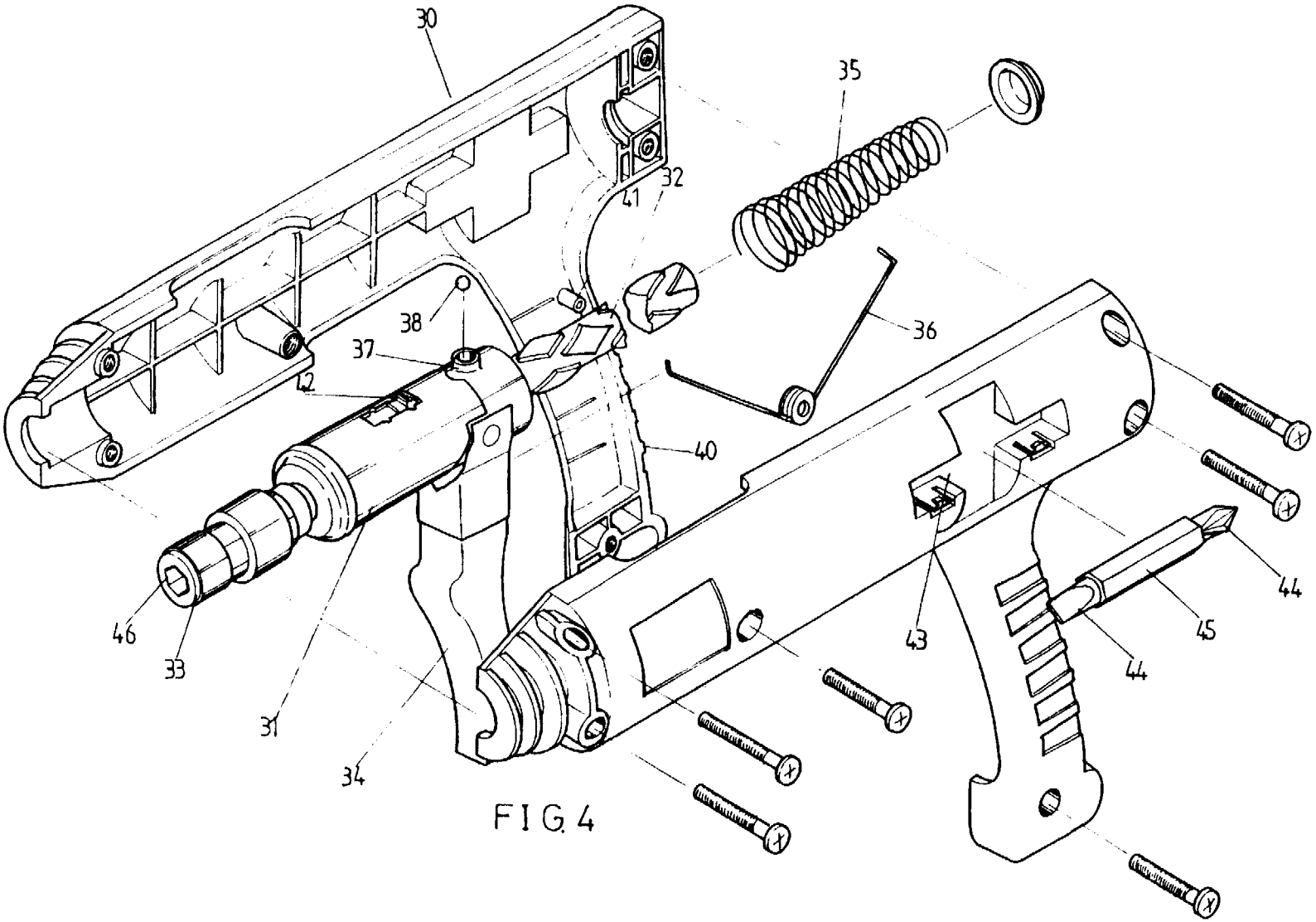
FIG. 4 is an exploded 3-D view of the present invention.

The screwdriver of the present invention includes one pistol body 30, one sliding rotation actuator 31, one helically grooved operating rod 32, one collet or chuck 33, one trigger 34, one spring 35, and one torsion spring 36. The key feature of the invention which provides an improvement over the prior art semiautomatic pistol gripped screwdrivers resides in the inclusion of a cup or holder 37 containing a ball bearing therein located on the top of the sliding rotation actuator 31 as shown in FIG. 4. When the actuator is installed within the pistol body, the ball bearing protrudes into a slide slot 39 located in the top inside portion of the pistol body whereby the ball bearing rolls through the length of the slot while being held in place within the cup or holder 37 when the sliding rotation actuator moves forward or backward. This arrangement provides perfect positioning of the sliding rotation actuator as it moves backward or forward and improves the slidability and stability of the actuator during use.

In addition the present invention includes a spring 35 located to the rear of the sliding rotation actuator and around the helically grooved operating rod 32 and a supporting torsion spring 36 attached to the handle and trigger. One end of torsion spring 36 is connected to the inlet of the top end inside the trigger 34 and another end of spring 36 is connected to hole 41 of the handle 40 of the pistol body 30.

Thus when the trigger is pulled, the spring provides force against the trigger to thereby recoil the trigger forward. In addition pulling the trigger also causes the actuator to move backward against the force of spring 35 so that spring 35 becomes compressed. The compressed spring 35 then supplies force needed to recoil the actuator forward. Thus both springs cooperate with each other for recoiling the actuator and the trigger.

Since the structure of the sliding rotation actuator, the collet or chuck 33, the helically grooved rod 32 and switcher 42 are conventional components used in the prior art devices of this type and are well known to those skilled in the art, details of these structures are not included herewith.

Figure 5:
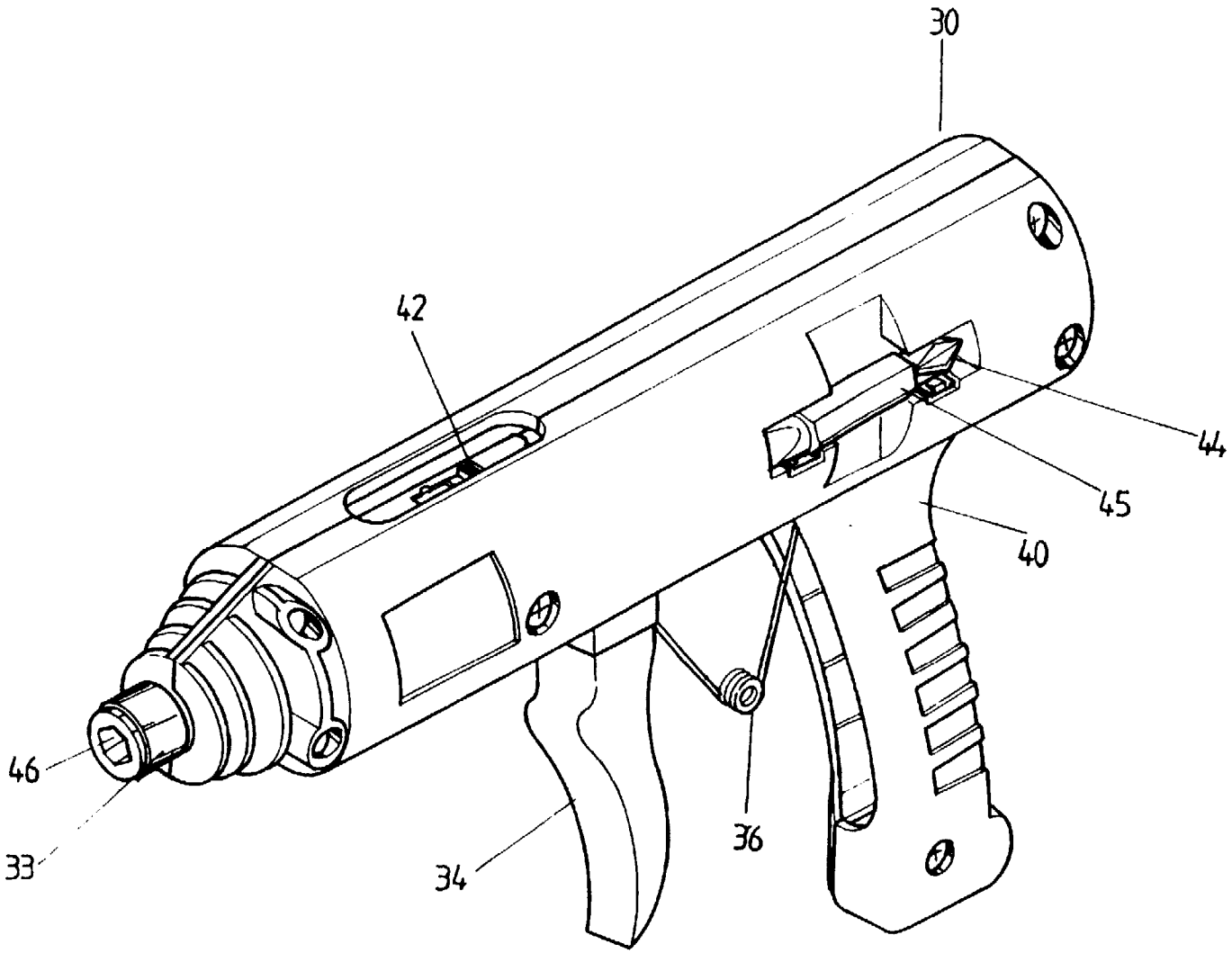
FIG. 5 is an assembled 3-D view of the present invention.
Figure 6:
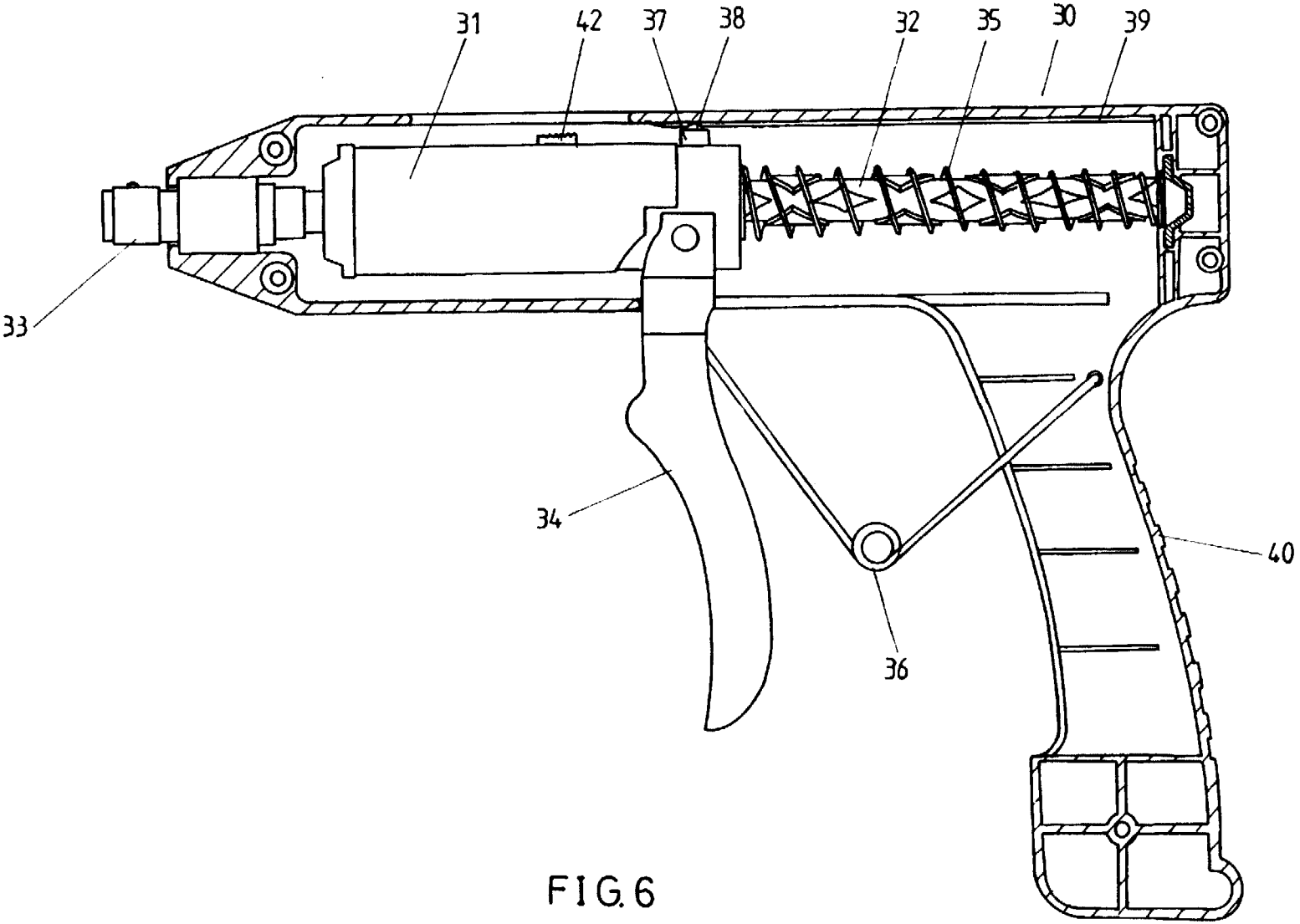
FIG. 6 is an assembled 3-D sectional view of the present invention.

The present invention also provides indentations on the outside of the pistol body along the sides thereof which are configured to hold screwdriver bits having various types of functional heads so that they can be easily inserted therein and retrieved as needed therefrom. Such an indentation is shown as receptacle 46 in FIGS. 4 and 5.

I claim:

1. In a semi-automatic pistol-gripped screwdriver of the type having a handle attached thereto; a helically grooved operating shaft; a sliding rotation actuator mounted on said shaft for sliding engagement with said shaft whereby said actuator causes rotation of said shaft as said actuator slides forward or backward along said shaft; a collet or chuck for holding a screwdriver bit, said collet or chuck being attached to said shaft so that rotation of said shaft causes rotation of said collet or chuck; a coiled spring around said shaft behind said actuator whereby said actuator compresses said spring when said actuator slides backward so that said compressed spring pushes against said actuator in a forward direction while said spring is compressed; a trigger which is attached to said actuator so that pulling said trigger causes said actuator to slide backward; said actuator, said shaft and said coiled spring being located in a housing; wherein the improvement comprises:

a torsion spring attached to said trigger and said handle for recoiling said trigger after said trigger has been pulled; a cup with a ball bearing located therein, said cup being attached to the top of actuator; a slide slot located within said housing for rolling engagement with a portion of said ball bearing which protrudes into said slot; said housing including at least one inwardly projecting receptacle for holding screwdriver bits on the outside of said housing.

* * * * *